US009891562B2

(12) United States Patent
Yamada et al.

(10) Patent No.: US 9,891,562 B2
(45) Date of Patent: Feb. 13, 2018

(54) IMAGE FORMING APPARATUS AND CONVEYANCE CONTROL METHOD

(71) Applicant: KONICA MINOLTA, INC., Chiyoda-ku, Tokyo (JP)

(72) Inventors: Takashi Yamada, Tokyo (JP); Mikihiro Yamakawa, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/457,162

(22) Filed: Mar. 13, 2017

(65) Prior Publication Data

US 2017/0269518 A1 Sep. 21, 2017

(30) Foreign Application Priority Data

Mar. 15, 2016 (JP) ..... 2016-051323

(51) Int. Cl.
*G03G 15/20* (2006.01)
*G03G 15/00* (2006.01)

(52) U.S. Cl.
CPC ..... *G03G 15/2028* (2013.01); *G03G 15/70* (2013.01)

(58) Field of Classification Search
CPC ... G03G 15/5012; G03G 15/657; G03G 15/70
See application file for complete search history.

(56) References Cited

U.S. PATENT DOCUMENTS 6,011,936 A * 1/2000 Kaneko ..... G03G 15/60 399/124
7,391,980 B2 * 6/2008 Sekiguchi ..... G03G 15/70 399/122
2005/0191066 A1 * 9/2005 Yamazaki ..... G03G 15/161 399/21

FOREIGN PATENT DOCUMENTS

JP 2003140488 A 5/2003

* cited by examiner

*Primary Examiner* — Gregory H Curran
(74) *Attorney, Agent, or Firm* — Cantor Colburn LLP

(57) ABSTRACT

An image forming apparatus includes: a fixing section configured to fix a toner image formed on a recording medium to the recording medium by conveying the recording medium while heating and pressing the recording medium at a fixing nip; a conveyance section configured to convey the recording medium toward the fixing nip while sandwiching the recording medium; and a control section configured to control the fixing section such that, at a timing after an image formation operation on the recording medium is stopped during the image formation operation, conveyance of the recording medium in the fixing section is stopped before the conveyance of the recording medium in the conveyance section is stopped, and that a timing of stopping the conveyance of the recording medium in the fixing section is changed in accordance with a type of the recording medium.

20 Claims, 7 Drawing Sheets

IMAGE FORMING APPARATUS AND CONVEYANCE CONTROL METHOD

CROSS REFERENCE TO RELATED APPLICATIONS

The entire disclosure of Japanese Patent Application No. 2016-051323, filed on Mar. 15, 2016, including description, claims, drawings and abstract are incorporated herein by reference in its entirety.

BACKGROUND OF THE INVENTION

1. Field of the Invention

The present invention relates to an image forming apparatus and a conveyance control method.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to a photoconductor drum (image carrier) on which the electrostatic latent image is formed, whereby a toner image is formed. Further, the toner image is directly or indirectly transferred to a sheet, and then heat and pressure are applied to the sheet at a fixing nip to form a toner image on the sheet.

FIG. 1 illustrates a sheet conveyance state around a fixing nip. As illustrated in FIG. 1, fixing section 60 in the above-mentioned image forming apparatus includes fixing belt 61, heating roller 62, fixing roller 63 and pressure roller 64. Fixing belt 61 is wound around heating roller 62 and fixing roller 63. Pressure roller 64 forms a fixing nip by sandwiching fixing belt 61 between fixing roller 63 and pressure roller 64. Fixing section 60 conveys sheet S while heating and pressing sheet S at the fixing nip.

SUMMARY OF THE INVENTION

Incidentally, for example, when sheet S is being sandwiched between the fixing nip and the conveyance section disposed on the upstream side of the fixing nip, jam or the like may occur in the image forming apparatus. FIG. 1 illustrates a transfer section that includes secondary transfer roller 424, intermediate transfer belt 421 and backup roller 423B as the conveyance section. When jam or the like occurs in the image forming apparatus, the image formation operation, that is, the conveyance of sheet S is required to be stopped even during the image formation operation. In this case, when the timing of stopping the conveyance of sheet S in fixing section 60 is delayed, an end portion of sheet S passed through the fixing nip may be wound around fixing belt 61 in fixing section 60 (see the dashed line), and therefore it is desirable to immediately stop the conveyance of sheet S by fixing section 60.

However, in the case where the image formation operation is stopped during the image formation operation, the conveyance of sheet S in the conveyance section may not be immediately stopped in some situation. For example, in the case of the transfer section, since stoppage is required to be performed after stopping the high-voltage power supply and the developing bias in the developing device, the conveyance operation is required to be continued for a predetermined time after the occurrence of jam. The reason for this is that the carrier in the developing device is attached to the photoconductor drum, and the photoconductor drum, the intermediate transfer belt and the like are damaged.

Therefore, even when the conveyance of sheet S in fixing section 60 is immediately stopped at the time of occurrence of jam or the like, the conveyance operation of the transfer section on the upstream side is continued for a predetermined time, and consequently the degree of upward slack of sheet S is undesirably increased at a position between the transfer nip and the fixing nip (see the broken line). In particular, in the case of sheet S having high rigidity such as sheet S having a large thickness and sheet S having a large basis weight, the shape of the slacked portion is held, and this portion may damage the surrounding members of intermediate transfer belt 421 and the like by making contact with the members and the like.

It is to be noted that Japanese Patent Application Laid-Open No. 2003-140488 discloses a configuration in which, when jam occurs, the sheet conveyance in the transfer section is stopped, and thereafter the sheet conveyance in the fixing section is stopped. When the sheet conveyance in the fixing section is stopped at such a timing, however, a certain period of time is required for stopping the fixing section, and consequently sheet winding around the fixing section may occur.

An image forming apparatus reflecting one aspect of the present invention includes: a fixing section configured to fix a toner image formed on a recording medium to the recording medium by conveying the recording medium while heating and pressing the recording medium at a fixing nip; a conveyance section configured to convey the recording medium toward the fixing nip while sandwiching the recording medium; and a control section configured to control the fixing section such that, at a timing after an image formation operation on the recording medium is stopped during the image formation operation, conveyance of the recording medium in the fixing section is stopped before the conveyance of the recording medium in the conveyance section is stopped, and that a timing of stopping the conveyance of the recording medium in the fixing section is changed in accordance with a type of the recording medium.

In a conveyance control method of an image forming apparatus reflecting one aspect of the present invention, the image forming apparatus includes: a fixing section configured to fix a toner image formed on a recording medium to the recording medium by conveying the recording medium while heating and pressing the recording medium at a fixing nip; and a conveyance section configured to convey the recording medium toward the fixing nip while sandwiching the recording medium, the method including: controlling the fixing section such that, at a timing after an image formation operation on the recording medium is stopped during the image formation operation, conveyance of the recording medium in the fixing section is stopped before the conveyance of the recording medium in the conveyance section is stopped, and that a timing of stopping the conveyance of the recording medium in the fixing section is changed in accordance with a type of the recording medium.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
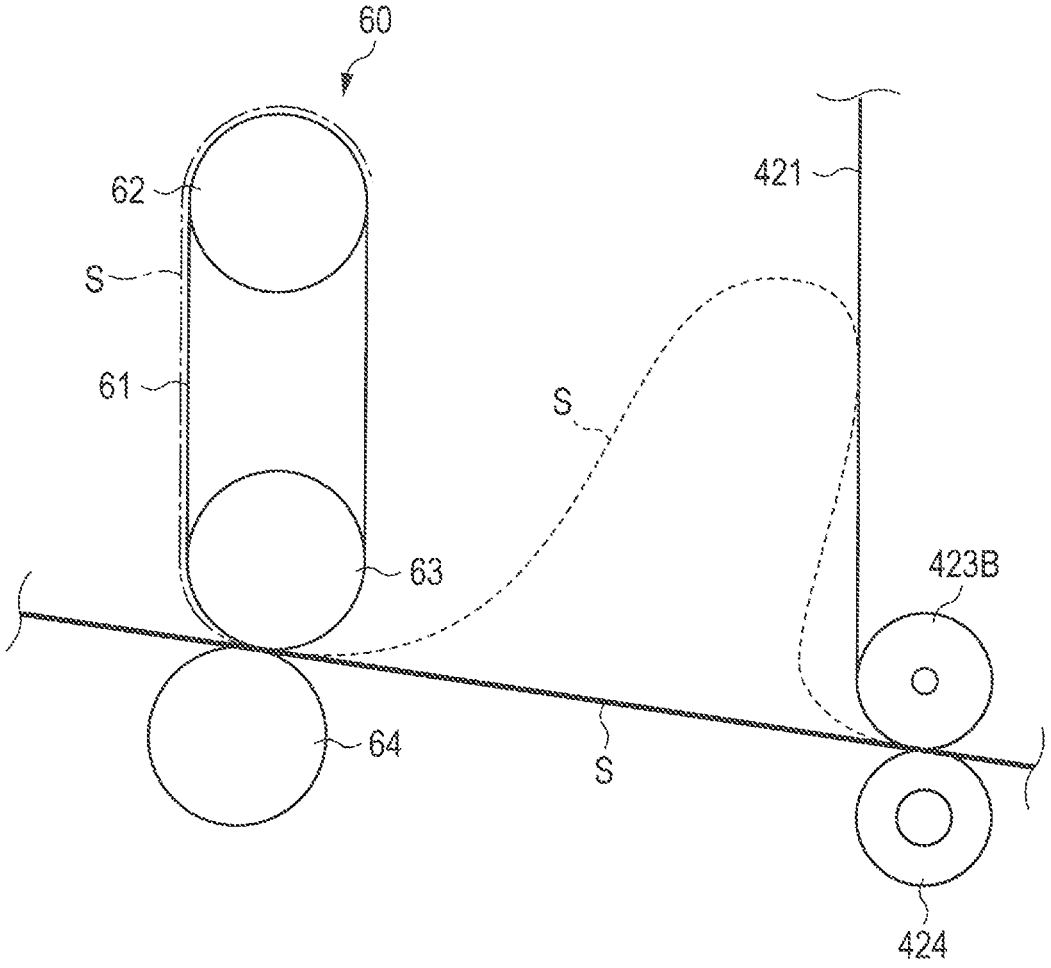
FIG. 1 illustrates a sheet conveyance state around a fixing nip.
Figure 2:
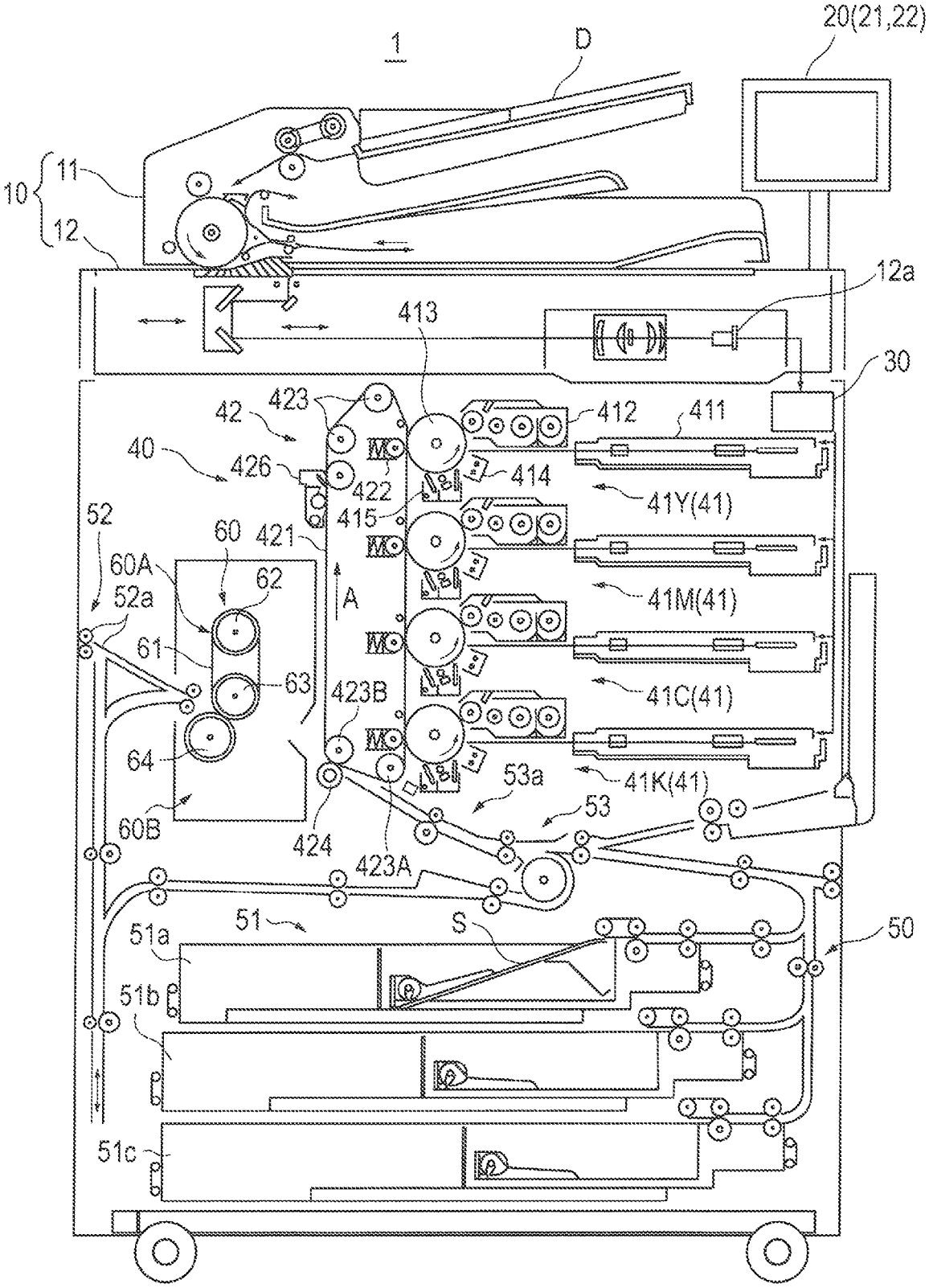
FIG. 2 schematically illustrates a general configuration of an image forming apparatus according to the present embodiment.
Figure 3:
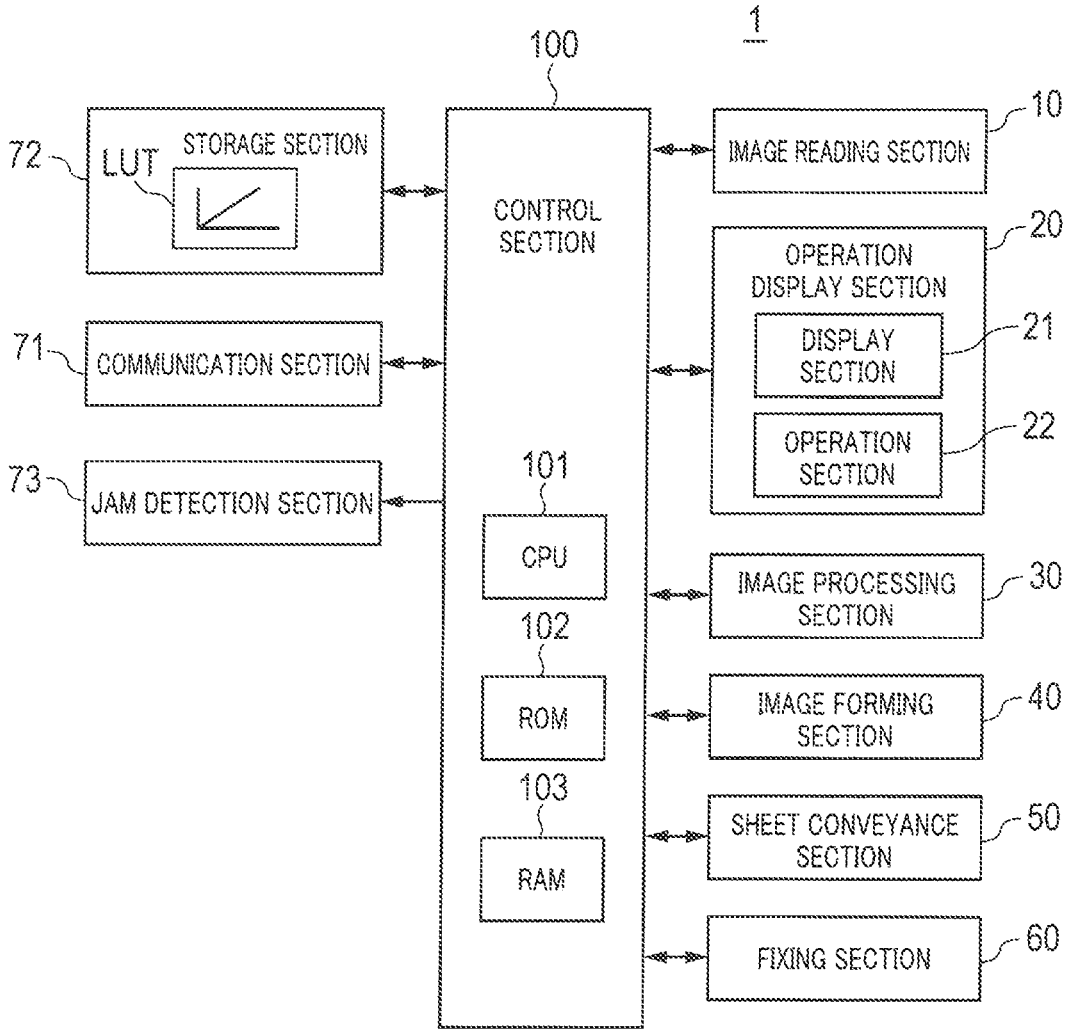
FIG. 3 illustrates a principal part of a control system of the image forming apparatus according to the present embodiment.

In the following, the present embodiment is described in detail with reference to the drawings. FIG. 2 schematically illustrates a general configuration of image forming apparatus 1 according to the present embodiment. FIG. 3 illustrates a principal part of a control system of image forming apparatus 1 according to the present embodiment.

Image forming apparatus 1 illustrated in FIGS. 2 and 3 is a color image forming apparatus of an intermediate transfer system using electrophotographic process technology. Specifically, image forming apparatus 1 transfers color toner images of C (cyan), M (magenta), Y (yellow), and K (black) formed on a photoconductor onto an intermediate transfer body (primary-transfer), superposes the toner images of the four colors on the intermediate transfer body, and then transfers the images onto a sheet (secondary transfer), thereby forming an image. Sheet S corresponds to the "recording medium" of the embodiment of the present invention.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

Image forming apparatus 1 includes image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data (input image data) transmitted from the external apparatus, and performs control to form an image on sheet S on the basis of the image data. Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) provided with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drum 413 is a negative-charging type organic photoconductor (OPC) having photoconductivity in which an undercoat layer (UCL), a charge generation layer (CGL), and charge transport layer (CTL) are sequentially stacked on a peripheral surface of a conductive cylindrical body made of aluminum (aluminum raw pipe), for example.

Charging device 414 causes corona discharge to evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component reverse type, and attaches toners of respective color components to the surface of photoconductor drums 413, and visualizes the electrostatic latent image to form a toner image. Developing device 412 forms a toner image on the surface of photoconductor drum 413 by supplying the toner included in the developer to photoconductor drum 413.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like. Intermediate transfer unit 42 corresponds to the "conveyance section" of the embodiment of the present invention.

Intermediate transfer belt 421 is composed of an endless belt, and is stretched around the plurality of support rollers 423 in a loop form. At least one of the plurality of support rollers 423 is composed of a driving roller, and the others are each composed of a driven roller. When driving roller rotates, intermediate transfer belt 421 travels in direction A at a constant speed. Intermediate transfer belt 421 has conductivity and elasticity, and is driven into rotation with a control signal from control section 100.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed. The secondary transfer nip corresponds to the "transfer nip" of the embodiment of the present invention.

Belt cleaning device 426 removes transfer residual toner which remains on the surface of intermediate transfer belt 421 after a secondary transfer.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to backup roller 423B, and an electric charge of the polarity identical to the polarity of the toner is applied to the front side, that is, a side of sheet S that makes contact with intermediate transfer belt 421 whereby the toner image is electrostatically transferred to sheet S.

Fixing section 60 includes upper fixing section 60A having a fixing side member disposed on a fixing surface side, that is, a side of the surface on which a toner image is formed, of sheet S, lower fixing section 60B having a rear side supporting member disposed on the rear surface side, that is, a side of the surface opposite to the fixing surface, of sheet S, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S.

Upper side fixing section 60A includes endless fixing belt 61, heating roller 62 and fixing roller 63, which serve as a fixing side member. Fixing belt 61 is installed in a stretched state between heating roller 62 and fixing roller 63.

Heating roller 62 incorporates a heating source (halogen heater) and applies heat to fixing belt 61. The heating source applies heat to heating roller 62, and as a result, fixing belt 61 is heated.

Fixing roller 63 is rotated clockwise by control section 100. When fixing roller 63 rotates, fixing belt 61 and heating roller 62 rotate in the clockwise direction to follow the rotation of fixing roller 63.

Lower fixing section 60B includes pressure roller 64 that is the rear side supporting member. Together with fixing belt 61, pressure roller 64 forms a fixing nip for conveying sheet S in a sandwiching manner. Pressure roller 64 is driven into rotation in the counterclockwise direction by control section 100.

In fixing section 60 of the present embodiment, the conveyance of sheet S is stopped when the operations of fixing roller 63 and pressure roller 64, that is, the rotation operations, are stopped under the control of control section 100. Fixing roller 63 and pressure roller 64 correspond to the "pair of rotation member" of the embodiment of the present invention.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance.

Conveyance path section 53 includes a plurality of pairs of conveyance rollers such as a pair of registration rollers 53*a* and the like. Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

In addition, in the present embodiment, jam detection section 73 that detects the occurrence of jam in image forming apparatus 1 is provided as illustrated in FIG. 3. Jam detection section 73 is, for example, sensors which are not illustrated in the drawing and are disposed on the upstream side and on the downstream side of the secondary transfer nip in the conveyance direction. Jam detection section 73 detects passage of an end of sheet S to detect jam of sheet S. Specifically, jam detection section 73 determines that jam of sheet S is caused at secondary transfer nip when, after a certain period has elapsed after passage of an end of sheet S is detected by the sensor on the upstream side, the sensor on the downstream side does not detect passage of an end of sheet S. When jam of sheet S is caused, jam detection section 73 outputs jam information relating to the jam to control section 100.

When acquiring jam information, control section 100 performs an operation of stopping the image formation operation during the image formation operation, or more specifically, an operation of stopping the conveyance of sheet S which is being conveyed. In addition to the acquisition of jam information, when failure of a component or the like occurs in image forming apparatus 1, control section 100 acquires failure information relating to the failure and performs an operation of stopping the image formation operation during the image formation operation.

Incidentally, in the case where the image formation operation is stopped during the image formation operation, when the timing of stopping the conveyance of sheet S in fixing section 60 is delayed, sheet S is wound around fixing belt 61. In view of this, in the case where the image formation operation is stopped during the image formation operation, it is desirable to stop the conveyance of sheet S by fixing section 60 as soon as possible. In addition, in intermediate transfer unit 42, the stoppage is required to be performed after the high-voltage power supply and the developing bias in developing device 412 are stopped, and therefore the conveyance operation is required to be continued for a predetermined time after the occurrence of jam.

Figure 4:
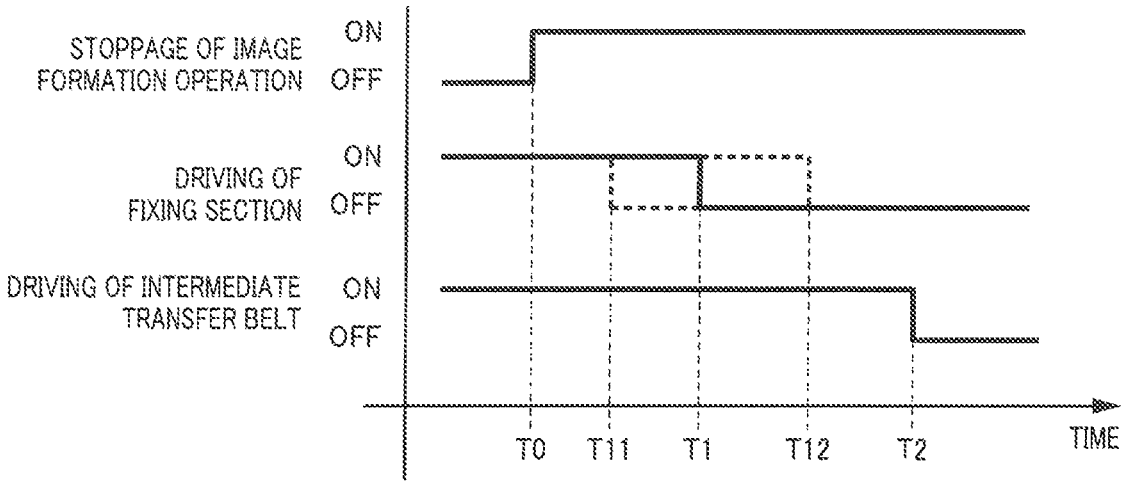
FIG. 4 is a timing chart showing a stopping state of an image formation operation, a driving state of a fixing section and a driving state of an intermediate transfer belt.

FIG. 4 is a timing chart showing a stopping state of an image formation operation, a driving state of fixing section 60 and a driving state of intermediate transfer belt 421. In FIG. 4, "ON" of "stoppage of image formation operation" means that the image formation operation is in a stopping state, and "OFF" means that the image formation operation is in an operation state. In addition, in FIG. 4, "ON" of "driving of fixing section" means that fixing section 60 is in an operation state, and "OFF" means that fixing section 60 is in a stopping state. In addition, in FIG. 4, "ON" of "driving of intermediate transfer belt" means that the intermediate transfer belt 421 is in an operation state, and "OFF" means that intermediate transfer belt 421 is in a stopping state.

In consideration of winding of sheet S around fixing belt 61 and continuation of the conveyance operation of intermediate transfer unit 42, as illustrated in FIG. 4, control section 100 stops the conveyance of sheet S in fixing section 60 at a timing (for example, time T1) between the timing when the image formation operation is stopped during the image formation operation (time T0), and the timing when the conveyance of sheet S in intermediate transfer unit 42 is stopped (time T2). With such an operation, sheet S is sandwiched at both of the secondary transfer nip and the fixing nip, and therefore upward slack of sheet S is caused. When the degree of the slack becomes excessive, sheet S may make contact with surrounding members such as intermediate transfer belt 421, and may damage the surrounding members at the time of unjamming, for example.

In view of this, control section 100 performs an operation for changing the timing of stopping the conveyance of sheet S in fixing section 60 (which is hereinafter referred to as "stop timing") in accordance with the type of sheet S. The type of sheet S is the basis weight and the thickness of sheet S. Sheet S having a large basis weight and sheet S having a large thickness have high rigidity, and therefore tend to easily damage the surrounding members when the degree of the slack is excessive and the shape of the slacked sheet is held. In view of this, control section 100 delays the stop timing of fixing section 60 as the basis weight of sheet S increases. In addition, control section 100 delays the stop timing of fixing section 60 as the thickness of sheet S increases. In the example illustrated in FIG. 4, for example, in the case of sheet S having a large basis weight greater than that of sheet S whose stop timing of fixing section 60 is set at time T1, the stop timing of fixing section 60 is set at time T12 which is later than time T1. In this manner, the degree of the slack of sheet S between the secondary transfer nip and the fixing nip can be prevented from becoming excessive, and in turn, the surrounding members can be prevented from being damaged. In addition, in the case of sheet S having high rigidity, even when the stop timing of fixing section 60 is delayed to a certain degree, the sheet does not easily stick to fixing belt 61 for its rigidity, and therefore the winding around fixing belt 61 is not easily caused.

In addition, since sheet S having a small basis weight and sheet S having a small thickness have low rigidity, such sheets S stick to fixing belt 61 of fixing section 60, and are easily wound around fixing belt 61 of fixing section 60 when the stop timing of fixing section 60 is delayed. In view of this, control section 100 advances the stop timing of fixing section 60 as the basis weight of sheet S decreases. In addition, control section 100 advances the stop timing of fixing section 60 as the thickness of sheet S decreases. In the example illustrated in FIG. 4, for example, in the case of sheet S having a basis weight smaller than that of sheet S whose stop timing of fixing section 60 is set at time T1, the stop timing of fixing section 60 is set at time T11 which is earlier than time T1. In this manner, in the case where the image formation operation is stopped during the image formation operation, winding of sheet S around fixing belt 61 can be suppressed. In addition, in the case of sheet S having low rigidity, even when the stop timing of fixing section 60 is advanced and the slack of sheet S increased, the sheet does not easily damage the surrounding members for its low rigidity, and therefore, it is possible to suppress damaging of the surrounding members even when the stop timing is advanced.

In addition, control section 100 determines the stop timing of fixing section 60 in accordance with the type of sheet S by referring to Table 1 and in Table 2 in storage section 72 and the like, for example. Table 1 shows stop timings of corresponding basis weights of sheet S, and Table 2 shows stop timings of corresponding thicknesses of sheet S. In addition, in Table 1 and Table 2, the distance between the secondary transfer nip and the fixing nip is set to 169 mm, and the conveyance speed of sheet S is set to 460 mm/sec. In addition, in Table 1 and Table 2, the stop timing is based on the case where the period from stoppage of the image formation operation until completion of stoppage of intermediate transfer unit 42 is 500 msec. In addition, the stop timing of fixing section 60 is the period from stoppage of the image formation operation until an end of sheet S advances halfway around the fixing belt, when it is assumed that that no surrounding member is provided after the fixing nip. For example, the stop timing of fixing section 60 is set as the time for advancing halfway around fixing belt 61 by 150 mm in the case where fixing belt 61 has a diameter of 100 mm and a circumference of 314 mm. In Table 1 and Table 2, the stop timing of fixing section 60 is defined by the time elapsed from the timing (time T0, in FIG. 4 and FIG. 5) at which the image formation operation is stopped during the image formation operation.

TABLE 1

| Basis weight(b/m2) | Stop timing |
|---|---|
| 176 or smaller | 0 msec |
| 177-256 | 300 msec |
| 257 or greater | 450 msec |

TABLE 2

| Thickness (μm) | Stop timing |
|---|---|
| 190 or smaller | 0 msec |
| 191-280 | 300 msec |
| 281 or greater | 450 msec |

It is to be noted that "176 or smaller" in Table 1 and "190 or smaller" in Table 2 represent the basis weight or the thickness of a thin sheet whose risk of winding around the fixing belt is high. In addition, "177 to 256" in Table 1 and "191 to 280" in Table 2 represent the basis weight or the thickness of a plain sheet whose risk of winding around the fixing belt is relatively low, and whose risk of damaging the surrounding members when the slack is increased is relatively low. In addition, "257 or greater" in Table 1 and "281 or greater" in Table 2 represent the basis weight or the thickness of a thick sheet whose risk of damaging the surrounding members when the slack is increased is high.

In addition, the size of sheet S may be used as the type of sheet S. The reason for this is that, when the length of sheet S in the conveyance direction is large, the slack between the secondary transfer nip and the fixing nip may possibly be increased by its length, and consequently the stop timing of fixing section 60 is required to be changed in accordance with the length. In this case, preferably, control section 100 performs an operation of delaying the stop timing of fixing section 60 as the length of sheet S in the conveyance direction increases.

In addition, the brand of sheet S may be used as the type of sheet S in combination with the above-mentioned type of sheet S. The reason for this is that, even with the same basis weight, the quality of sheet S can be slightly different from each other depending on the brand of sheet S, and in turn, the stop timing of fixing section 60 can be different from each other, and consequently, the stop timing of fixing section 60 is required to be changed in accordance with the difference in brand. That is, even when sheet S has the same basis weight and thickness, the rigidity (hardness) can be different depending on the quality of sheet S, and the stop timing of fixing section 60 is changed in accordance with the brand of sheet S.

Figure 5:
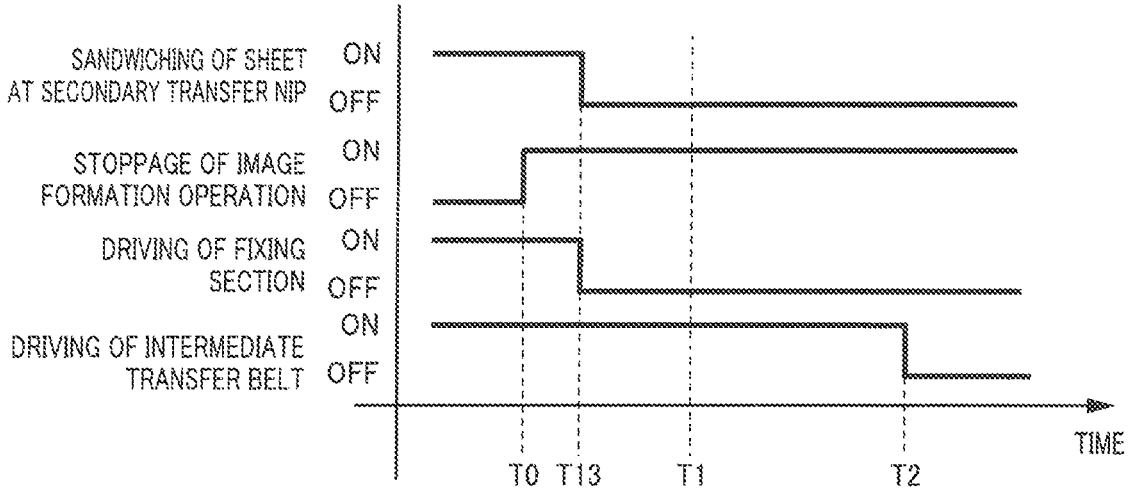
FIG. 5 is a timing chart showing a sandwiching state of a sheet at a secondary transfer nip, a stopping state of an image formation operation, a driving state of a fixing section and a driving state of an intermediate transfer belt.

In addition, for example, when the sandwiching of sheet S at the secondary transfer nip is released, sheet S does not slacken between the secondary transfer nip and the fixing nip. In view of this, to suppress the winding of sheet S around fixing belt 61, it is required to stop the conveyance in fixing section 60 at an earlier timing. FIG. 5 is a timing chart showing a sheet sandwiching state at the secondary transfer nip, a stopping state of an image formation operation, a driving state of fixing section 60 and a driving state of intermediate transfer belt 421. In FIG. 5, "ON" of "sheet sandwiching at the secondary transfer nip" means that sheet S is sandwiched at the secondary transfer nip, and "OFF" means that sheet S is not sandwiched at the secondary transfer nip.

As illustrated in FIG. 5, when the sandwiching of sheet S at the secondary transfer nip is released before the conveyance of sheet S in fixing section 60 is stopped, control section 100 stops the conveyance of sheet S in fixing section 60 at the timing when the sandwiching of sheet S at the secondary transfer nip is released. In the example illustrated in FIG. 5, in the case where the stop timing of fixing section 60 is originally set at time T1, when the sandwiching of sheet S at the secondary transfer nip is released at time T13 which is earlier than time T1, the stop timing of fixing section 60 is set to time T13. In this manner, winding of sheet S around fixing belt 61 can be further suppressed.

It is to be noted that the timing when the sandwiching of sheet S at the secondary transfer nip is released may be calculated based on the feeding timing of sheet S and the distance from the secondary transfer nip in intermediate transfer unit 42, or may be calculated based on the feeding timing of sheet S and a predetermined time period until the sheet S is conveyed to the secondary transfer nip from the feeding position.

Figure 6:
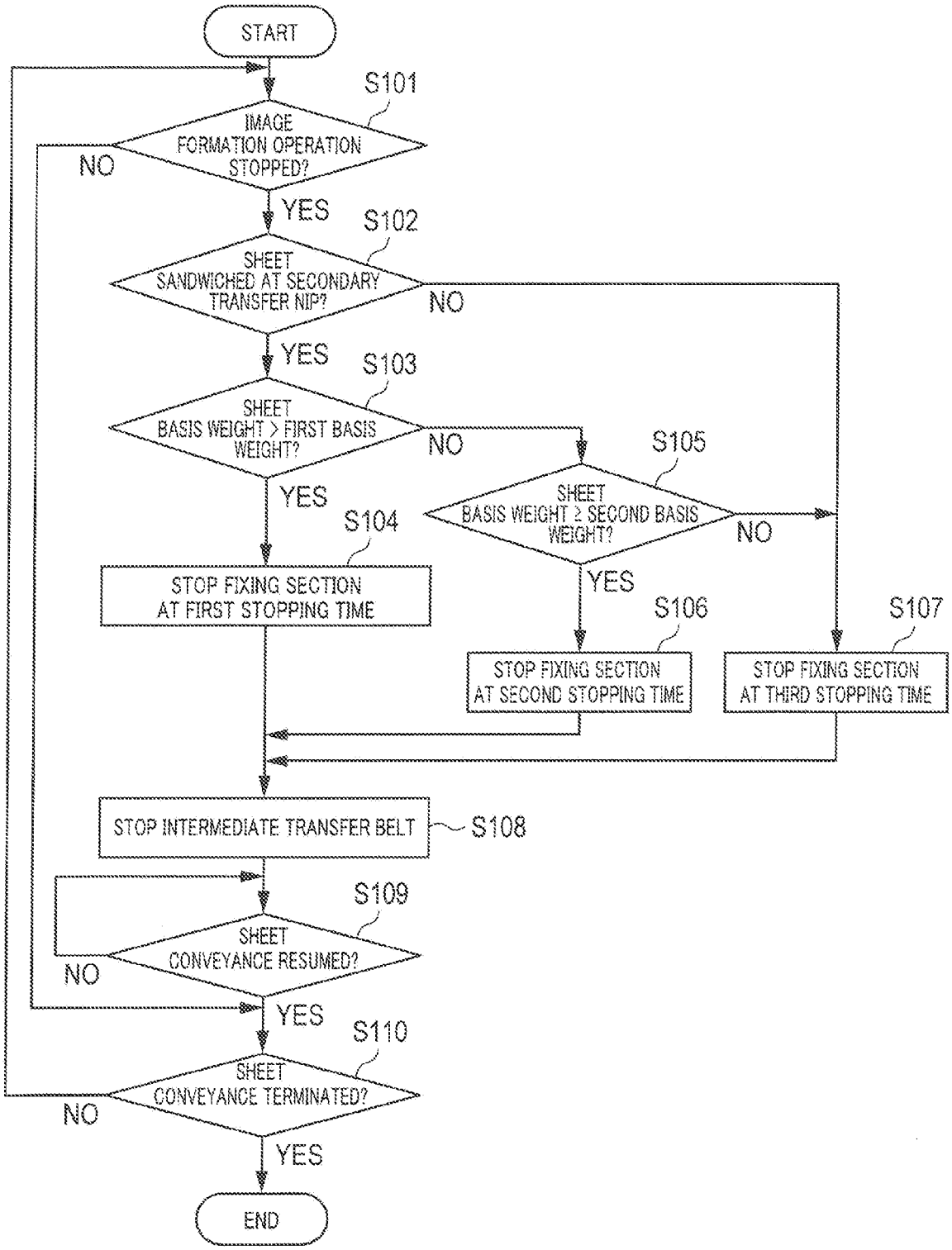
FIG. 6 is a flowchart of an exemplary sheet conveyance operation of the image forming apparatus according to the present embodiment.

Now an exemplary sheet conveyance operation in image forming apparatus 1 having the above-mentioned configuration is described. FIG. 6 is a flowchart of an exemplary sheet conveyance operation of image forming apparatus 1 according to the present embodiment. The process in FIG. 6 is executed when control section 100 receives a request of performing a printing job. It is to be noted that, in FIG. 6, the stop timing of fixing section 60 is determined based only on the basis weight of sheet S.

As illustrated in FIG. 6, control section 100 determines whether the image formation operation is stopped during the image formation operation (step S101). When it is determined that the image formation operation is not stopped (step S101, NO), the process is advanced to step S110. On the other hand, when it is determined that the image formation operation is stopped (step S101, YES), control section 100 determines whether sheet S is sandwiched at the secondary transfer nip (step S102).

When it is determined that sheet S is not sandwiched at the secondary transfer nip (step S102, NO), the process is advanced to step S107. On the other hand, when it is determined that sheet S is sandwiched at the secondary transfer nip (step S102, YES), control section 100 determines whether the basis weight of sheet S is greater than a first basis weight (for example, 257 g/m$^2$) (step S103).

When it is determined that the basis weight of sheet S is greater than the first basis weight (step S103, YES), control section 100 stops fixing section 60 at a first stopping time (step S104). The first stopping time is set to "450 msec" which is a stop timing corresponding to a basis weight of "257 or greater" in Table 1, for example. On the other hand, when the basis weight of sheet S is equal to or smaller than the first basis weight (step S103, NO), control section 100 determines whether the basis weight of sheet S is not smaller than a second basis weight (for example, 176 g/m$^2$) (step S105).

When it is determined that the basis weight of sheet S is not smaller than the second basis weight (step S105, YES), control section 100 stops fixing section 60 at a second stopping time (step S106). The second stopping time is set to "300 msec" which is a stop timing corresponding to a basis weight of "177 to 256" in Table 1, for example. On the other hand, when the basis weight of sheet S is smaller than the second basis weight (step S105, NO), control section 100 stops fixing section 60 at a third stopping time (step S107). The third stopping time is set to "0 msec" which is a stop timing corresponding to a basis weight of "176 or smaller" in Table 3, for example.

After step S104, step S106 and step S107, control section 100 stops intermediate transfer belt 421 (step S108). Next, control section 100 determines whether the conveyance of sheet S is resumed (step S109). When it is determined that the conveyance of sheet S is not resumed (step S109, NO), the process of step S109 is repeated. On the other hand, when it is determined that the conveyance of sheet S is resumed (step S109, YES), control section 100 determines whether the conveyance of sheet S is completed (step S110).

When the conveyance of sheet S is not completed (step S110, NO), the process is returned to step S101. When the conveyance of sheet S is completed (step S110, YES), control section 100 terminates this process.

In image forming apparatus 1 having the above-mentioned configuration, the stop timing of fixing section 60 is changed in accordance with the type of sheet S, and thus wounding of sheet S around fixing belt 61 can be suppressed while suppressing the damaging of the surrounding members due to excessive slack of sheet S between the fixing nip and the secondary transfer nip.

In addition, since the stop timing of fixing section 60 is delayed as the rigidity of sheet S increases, the degree of the slack of sheet S between the secondary transfer nip and the fixing nip can be prevented from becoming excessive, and in turn, damaging of the surrounding members can be suppressed.

In addition, since the stop timing of fixing section 60 is advanced as the rigidity of sheet S decreases, wounding of sheet S around fixing belt 61 can be suppressed. Thus, in the case where fixing section 60 is driven with sheet S being wound around fixing belt 61, a situation where unjamming cannot be easily performed can be suppressed, and damaging of the surface of fixing belt 61 can be suppressed.

In addition, when the sandwiching of sheet S at the secondary transfer nip is released, the stop timing of fixing section 60 is set to the timing when the sandwiching of sheet S at the secondary transfer nip is released, and thus winding of sheet S around fixing belt 61 can be further suppressed.

While Table 1 and Table 2 are set from the view point of preventing damaging of the surrounding members and winding of sheet S due to slack of sheet S in the above-mentioned embodiment, the present invention is not limited to this. For example, as shown in Table 3 and Table 4, the table may be set in consideration of only damaging of the surrounding members due to slack of sheet S. Table 3 shows stop timings of corresponding basis weights of sheet S, and Table 4 shows stop timings of corresponding thicknesses of sheet S.

TABLE 3

| Basis weight(b/m$^2$) | Stop timing |
|---|---|
| 256 or smaller | 0 msec |
| 257 or greater | 450 msec |

TABLE 4

| Thickness (μm) | Stop timing |
|---|---|
| 280 or smaller | 0 msec |
| 281 or greater | 450 msec |

It is to be noted that, also with the stop timing of fixing section 60 in Table 3 and Table 4, the stop timing of fixing section 60 is set to 0 msec in the case of the basis weight ("256 or smaller" in Table 3) and the thickness ("280 or smaller" in Table 4) corresponding to a thin sheet and a plain sheet which can cause winding, and thus the winding of sheet S around fixing belt 61 is not easily caused.

In addition, while the stop timing of fixing section 60 is changed in accordance with only the type of sheet S in the above-mentioned embodiment, the present invention is not limited to this. For example, control section 100 may control the stop timing of fixing section 60 in accordance with the information of the image formed at an end portion of sheet S. An example of the image information is the toner amount of a toner image. To be more specific, preferably, control section 100 advances the stop timing of fixing section 60 as the amount of the toner formed at an end portion of sheet S increases. When the amount of the toner formed at an end portion of sheet S is large, sticking to fixing belt 61 easily occurs, and therefore fixing section 60 is required to be stopped at an earlier timing. In this manner, with the above-mentioned operation, wounding of sheet S around fixing belt 61 can be suppressed.

Figure 7:
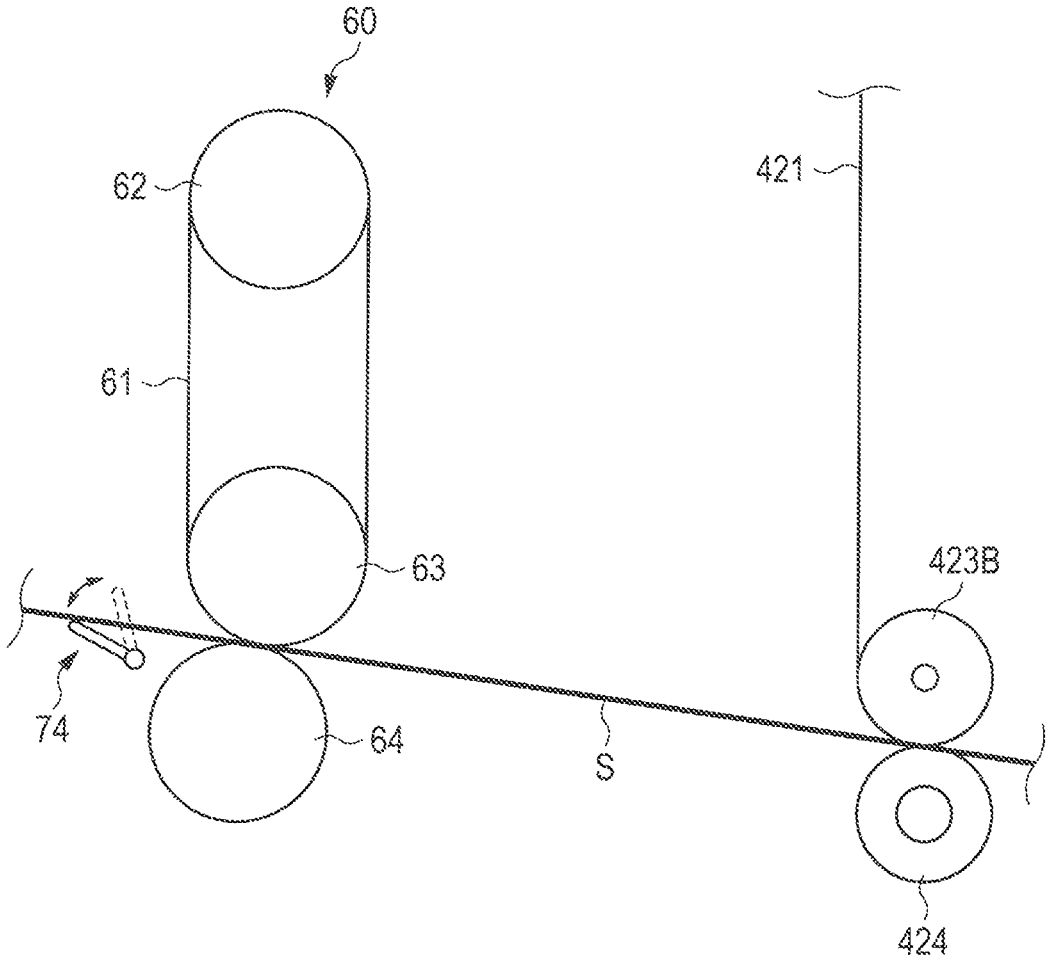
FIG. 7 illustrates a sheet conveyance state around a fixing nip according to modification 1.

In addition, the stop timing of fixing section 60 may be changed in accordance with the conveyance state of sheet S. For example, as illustrated in FIG. 7, the stop timing of fixing section 60 may be changed in accordance with a detection result of passage detection section 74 that detects passage of conveyed sheet S.

In this configuration, passage detection section 74 is disposed on the downstream side relative to fixing section 60 in the conveyance direction of sheet S such that whether sheet S is conveyed without being wound around fixing belt 61 can be detected. Passage detection section 74 is configured to be able to move between a broken line position located on the conveyance path of sheet S and a solid line position located outside the conveyance path. Passage detection section 74 is located at the broken line position when sheet S has not yet reached the position of passage detection section 74. When turned down by sheet S reaching that position and moved to the solid line position, passage detection section 74 detects passage of sheet S, and outputs the detection result to control section 100.

In the case where the image formation operation is stopped during the image formation operation of sheet S, when sheet S is sandwiched at secondary transfer nip and sheet S is detected by passage detection section 74, control section 100 delays the timing of stopping the conveyance of fixing section 60 in comparison with the case where sheet S is not detected by passage detection section 74. In the case where sheet S is detected by passage detection section 74 located at a position on the downstream side relative to fixing section 60, it is possible to confirm that sheet S is conveyed without being wound around fixing belt 61. Therefore, in this case, the slack amount of sheet S can be reduced by delaying the stop timing of fixing section 60.

In addition, in the case where the image formation operation of sheet S is stopped during the image formation operation, when no sheet S is detected by passage detection section 74 for a predetermined sheet feeding time after sheet S is fed, control section 100 advances the timing of stopping the conveyance of fixing section 60 in comparison with the case where sheet S is detected by passage detection section 74. The predetermined sheet feeding time is set to a time which is calculated from the conveyance distance between the position to which sheet S is fed and the position of passage detection section 74, and from the conveyance speed of sheet S, for example. When sheet S does not reach the position of passage detection section 74 within the predetermined sheet feeding time, it is recognized that sheet S is wound around fixing belt 61. Therefore, in this case, the winding of sheet S around fixing belt 61 can be suppressed by advancing the stop timing of fixing section 60.

Figure 8:
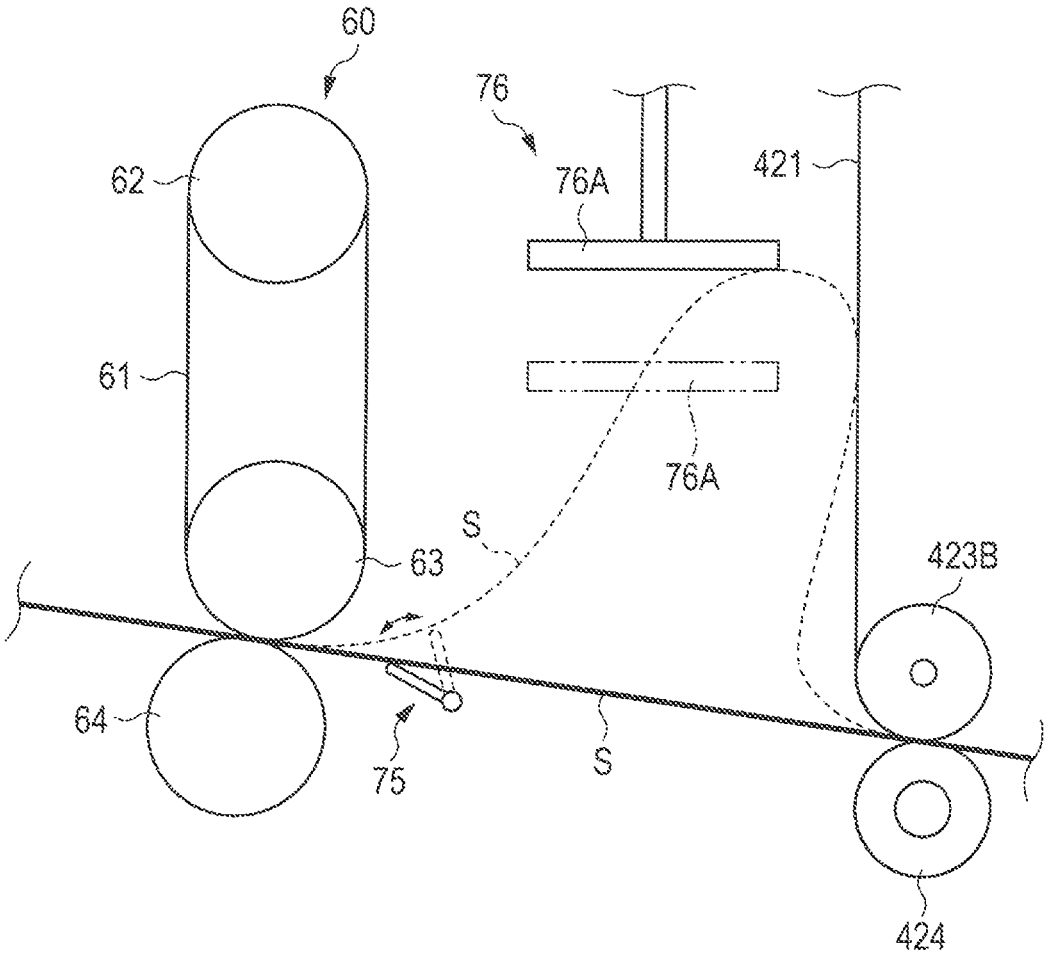
FIG. 8 illustrates a sheet conveyance state around a fixing nip according to modification 2.

In addition, as illustrated in FIG. 8, the stop timing of fixing section 60 may be changed in accordance with the slack amount of sheet S. In this configuration, first slack detection section 75 and second slack detection section 76 are provided between the secondary transfer nip and the fixing nip in the conveyance direction.

First slack detection section 75 is disposed on the conveyance path such that occurrence of slack of sheet S can be detected. First slack detection section 75 has a configuration similar to that of passage detection section 74 in FIG. 7. When first slack detection section 75 is located at the solid line position, control section 100 determines that slack of sheet S is not caused, or, that the slack amount is small. When first slack detection section 75 is located at the broken line position, control section 100 determines that the slack amount of sheet S is at a predetermined value or greater.

Second slack detection section 76 is located above the conveyance path, and includes contact section 76A capable of making contact with sheet S having a predetermined slack amount or greater. Second slack detection section 76 is movable in the upper and lower direction, and detects the slack amount of sheet S when contact section 76A makes contact with sheet S. Contact section 76A is set at the position illustrated with the chain double-dashed line in an initial state where no slack of sheet S is detected, for example. When sheet S makes contact with contact section 76A at the position of the chain double-dashed line, control section 100 determines that the slack amount of sheet S is increased.

Next, the operation of control section 100 having the configuration illustrated in FIG. 8 is described. Control section 100 changes the conveyance speed of sheet S in fixing section 60 based on a detection result detected by at least one of first slack detection section 75 and second slack detection section 76. For example, when the slack amount of sheet S is increased before the stop timing which is set based on the type of sheet S, the slack amount may be undesirably increased until the set stop timing is reached. Therefore, in this case, it is possible to prevent the slack amount of sheet S from being undesirably increased by increasing the conveyance speed of fixing section 60.

In the case where the image formation operation of sheet S is stopped during the image formation operation, control section 100 resumes the conveyance of sheet S in fixing section 60 when at least one of first slack detection section 75 and second slack detection section 76 detects slack of sheet S of a predetermined value or greater after the conveyance of sheet S in fixing section 60 is stopped, that is, when the slack amount of sheet S has a first slack amount. After the conveyance of sheet S is resumed, control section 100 continues the conveyance of sheet S in fixing section 60 until the slack amount of sheet S becomes a value equal to or smaller than the second slack amount that is smaller than the first slack amount. In this manner, when the slack amount is increased more than anticipated, it is possible to set the position to a position where the slack amount of sheet S is reduced, by resuming the conveyance of sheet S.

The reference for determining the first slack amount of first slack detection section 75 may be set to the broken line position in FIG. 8, and the reference for determining the first slack amount of second slack detection section 76 may be set to the solid line position in FIG. 8. The reference for determining the second slack amount of first slack detection section 75 may be set to the solid line position in FIG. 8, and the reference for determining the second slack amount of the second slack amount of second slack detection section 76 may be set to the chain double-dashed line position in FIG. 8.

It is to be noted that, as the configuration of FIG. 8, it is also possible to adopt a configuration in which only one of first slack detection section 75 and second slack detection section 76 is provided.

In addition, while the conveyance of sheet S in fixing section 60 is stopped by stopping fixing section 60 in the above-mentioned embodiment, the present invention is not limited to this. For example, the conveyance of sheet S may be stopped by releasing the fixing nip in fixing section 60. In this manner, sheet S at the fixing nip is released, and consequently slack of sheet S between the fixing nip and the secondary transfer nip is not easily caused. Thus, it is possible to advance the stop timing of fixing section 60 to suppress winding of sheet S around fixing belt 61. It should be noted that, in the case where the fixing nip is released after slack of sheet S is caused due to the difference in conveyance speed between fixing section 60 and the transfer section or the like, the shape of the slacked sheet S may possibly not be reset, and therefore, it is preferable to perform another operation for resuming the conveyance of sheet S in fixing section 60.

In addition, while intermediate transfer unit 42 is the conveyance section in the above-mentioned embodiment, the present invention is not limited to this. For example, the conveyance section may be a conveyance roller pair or the like.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The present invention is applicable to an image forming system composed of a plurality of units including an image forming apparatus. The units include, for example, a post-processing apparatus, an external apparatus such as a control apparatus connected with a network, and the like.

Although embodiments of the present invention has been described and illustrated Specifically, it is clearly understood that the same is by way of illustrated and example only and is not to be taken by way of limitation, the scope of the present invention is interpreted by terms of the appended claims.

What is claimed is:

1. An image forming apparatus comprising:

a fixing section configured to fix a toner image formed on a recording medium to the recording medium by conveying the recording medium while heating and pressing the recording medium at a fixing nip;

a conveyance section configured to convey the recording medium toward the fixing nip while sandwiching the recording medium; and a control section configured to control the fixing section such that, at a timing after an image formation operation on the recording medium is stopped during the image formation operation, conveyance of the recording medium in the fixing section is stopped before the conveyance of the recording medium in the conveyance section is stopped, and that a timing of stopping the conveyance of the recording medium in the fixing section is changed in accordance with a type of the recording medium.

2. The image forming apparatus according to claim 1, wherein the control section changes the timing of stopping the conveyance of the recording medium in the fixing section when the recording medium is sandwiched at the fixing nip and the conveyance section.

3. The image forming apparatus according to claim 1, wherein the type of the recording medium is a thickness of the recording medium.

4. The image forming apparatus according to claim 3, wherein the control section delays the timing of stopping the conveyance of the recording medium in the fixing section as the thickness of the recording medium increases.

5. The image forming apparatus according to claim 1, wherein the type of the recording medium is a basis weight of the recording medium.

6. The image forming apparatus according to claim 5, wherein the control section delays the timing of stopping the conveyance of the recording medium in the fixing section as the basis weight of the recording medium increases.

7. The image forming apparatus according to claim 1, wherein the type of the recording medium is a size of the recording medium.

8. The image forming apparatus according to claim 7, wherein the control section delays the timing of stopping the conveyance of the recording medium in the fixing section as the size of the recording medium in a conveyance direction increases.

9. The image forming apparatus according to claim 1, wherein the conveyance section is a transfer section configured to transfer a toner image to the recording medium by sandwiching the recording medium at a transfer nip.

10. The image forming apparatus according to claim 1, wherein, when the sandwiching of the recording medium in the conveyance section is released before the conveyance of the recording medium in the fixing section is stopped, the control section stops the conveyance of the recording medium in the fixing section at a timing when the sandwiching of the recording medium in the conveyance section is released.

11. The image forming apparatus according to claim 10, wherein the control section calculates the timing at which the sandwiching of the recording medium in the conveyance section is released based on a feeding timing of the recording medium and a distance to the conveyance section.

12. The image forming apparatus according to claim 10, wherein the control section calculates the timing at which the sandwiching of the recording medium in the conveyance section is released based on a feeding timing of the recording medium, and a time period set as a time period until the recording medium is conveyed to the conveyance section from a feeding position.

13. The image forming apparatus according to claim 1 further comprising a passage detection section disposed on a downstream side of the fixing section in a conveyance direction of the recording medium and configured to detect passage of the recording medium being conveyed, wherein in a case where the image formation operation on the recording medium is stopped during the image formation operation, when the recording medium is sandwiched by the conveyance section and the recording medium is detected by the passage detection section, the control section delays the timing of stopping the conveyance of the recording medium in the fixing section in comparison with a case where the recording medium is not detected by the passage detection section.

14. The image forming apparatus according to claim 1 further comprising a slack detection section disposed between the conveyance section and the fixing section in a conveyance direction of the recording medium and configured to detect slack of the recording medium, wherein when the slack detection section detects slack of the recording medium which is being conveyed, the control section changes a conveyance speed of the recording medium in the fixing section.

15. The image forming apparatus according to claim 1 further comprising a slack detection section disposed between the conveyance section and the fixing section in a conveyance direction of the recording medium and configured to detect slack of the recording medium, wherein in a case where the image formation operation on the recording medium is stopped during the image formation operation, when slack of a predetermined value or greater of the recording medium is detected by the slack detection section after the conveyance of the recording medium in the fixing section is stopped, the control section resumes the conveyance of the recording medium in the fixing section and continues the conveyance of the recording medium in the fixing section until slack of the predetermined value or greater of the recording medium is not detected by the slack detection section.

16. The image forming apparatus according to claim 1, wherein, when the image formation operation on the recording medium is stopped during the image formation operation, the control section changes the timing of stopping the conveyance of the recording medium in the fixing section in accordance with image information formed at an end portion of the recording medium.

17. The image forming apparatus according to claim 16, wherein the image information is a toner amount of a toner image formed at an end portion of the recording medium.

18. The image forming apparatus according to claim 1, wherein the fixing section includes a pair of rotation members that form the fixing nip, and stoppage of the conveyance of the recording medium in the fixing section is stoppage of rotation of the pair of rotation members.

19. The image forming apparatus according to claim 1, wherein stoppage of the conveyance of the recording medium in the fixing section is releasing of the fixing nip of the fixing section.

20. A conveyance control method of an image forming apparatus, the image forming apparatus including:

a fixing section configured to fix a toner image formed on a recording medium to the recording medium by conveying the recording medium while heating and pressing the recording medium at a fixing nip; and a conveyance section configured to convey the recording medium toward the fixing nip while sandwiching the recording medium, the method comprising:

controlling the fixing section such that, at a timing after an image formation operation on the recording medium is stopped during the image formation operation, conveyance of the recording medium in the fixing section is stopped before the conveyance of the recording medium in the conveyance section is stopped, and that a timing of stopping the conveyance of the recording medium in the fixing section is changed in accordance with a type of the recording medium.

* * * * *